US005188322A

United States Patent [19]

Kinstrey

[11] Patent Number: 5,188,322

[45] Date of Patent: Feb. 23, 1993

[54] EYEGLASS HOLDER

[76] Inventor: Patricia M. Kinstrey, P.O. Box 179, Esopus, N.Y. 12429

[21] Appl. No.: 782,102

[22] Filed: Oct. 24, 1991

[51] Int. Cl.[5] ..... A47G 23/00

[52] U.S. Cl. ..... 248/146; 248/902; 206/5

[58] Field of Search ..... 248/146, 311.2, 902; 206/5, 5.1, 6, 214; 493/914; 211/13, 69.1; D3/34; D16/129

[56] References Cited

U.S. PATENT DOCUMENTS

| | | | |
|---|---|---|---|
| D. 168,138 | 11/1952 | Baratelli | D3/34 |
| D. 206,097 | 10/1966 | Neiswanger | D16/129 |
| D. 229,861 | 1/1974 | Mende . | |
| D. 229,976 | 1/1974 | Zahn . | |
| 1,303,171 | 5/1919 | Curtin | 248/146 |
| 1,686,002 | 10/1928 | Herzon | 248/902 X |
| 3,735,597 | 2/1956 | Treleven | 248/902 X |
| 2,966,985 | 1/1961 | Morris | 206/5 |
| 3,281,106 | 10/1966 | Bogdanovich | 248/902 X |
| 3,519,138 | 7/1970 | Murray . | |
| 3,845,799 | 11/1974 | Mittell | 206/5 X |
| 5,032,019 | 7/1991 | Burchett | 248/902 X |

*Primary Examiner*—David M. Purol
*Attorney, Agent, or Firm*—Laurence R. Brown

[57] ABSTRACT

Eyeglasses are stored and protected when not in use, such as overnight, by providing a protective liner fitting the interior walls and outer rim of a generally cylindrical open mouthed receptacle of appropriate diameter and length to hold the eyeglasses in a safe and accessible position. The receptacle comprises in a preferred embodiment a coffee mug and the liner, a quilted and/or foam backed fabric material.

2 Claims, 2 Drawing Sheets

EYEGLASS HOLDER

TECHNICAL FIELD

This invention relates to eyeglass holders and more particularly it relates to protective inserts for eyeglass confining receptacles such as water glasses or coffee mugs.

BACKGROUND

When eyeglasses are not worn continuously they need to be temporarily held or stored when not in use in an appropriate case, stand or holder that protects the glasses from damage such as scratching of the lenses. This has been recognized in general in the prior art. Thus, specially designed upright receptacle holder desk stands are exemplified by Design U.S. Pat. Nos. 229,861, J. Mende, Jan. 8, 1974 and 229,976, M. Zahn, Jan. 15, 1974. This type of stand is shaped specially to receive a particular style and size of eyeglasses in a tight fitting relationship, and has no other purpose. Therefore, such stands are expensive and do not readily adapt to different styles, larger size lenses, and the like.

Also racks are known for holding spectacles laterally disposed in a cradle with the bows open, rather than upright with the bows closed, as seen in U.S. Pat. No. 3,519,138, D. F. Murray, Jul. 7, 1970. This construction also is not well adapted to different sizes and shapes of spectacles, and can accumulate dirt and dust that could scratch or soil the lenses. Also such devices are very critical in operation and require careful attention when depositing the spectacles in place.

There has not been a satisfactory solution to the problem of storing glasses temporarily when not in use, such as at night next to a bed or on a desk where reading and far-sighted glasses are interchanged from time to time. The storage of the glasses needs to be convenient and non-critical with glasses protected against scratching or bending forces, all in an environment that is acceptably decorative, easy to use, at a handy location and protective against accidental catastrophe. This is the objective of the present invention, thereby overcoming deficiencies of the prior art.

DISCLOSURE OF THE INVENTION

Eyeglasses of various sizes are stored upright with bows closed in the open mouth of a mug or similar water glass of appropriate size, depth and balance to orient the eyeglasses in an accessible position without significant danger of tipping, misplacement or damage to the eyeglasses.

The holder (mug) is lined with a decorative protective liner for protection of the eyeglasses from lens damage while stored and from impact damage upon entry and exit from the holder. In a preferred embodiment, the liner is made of a quilted and/or foam backed fabric fitted to a mug. The eyeglass protection liner constitutes the interior surface of the eyeglass holder comprising a lined mug, or the like. The liner is held in place by a decorative fabric rim overlapping onto the outside of the mug and preventing impact contact of the eyeglasses with any part of the mug holder as they are thrust thereinto for storage or removed for use. Fasteners may optionally be used to hold in place a soft fabric rim that tends to move out of place or become rumpled.

Further objects, features and advantages of the invention will be found throughout the following description, claims and drawings.

BRIEF DESCRIPTION OF THE DRAWINGS

In the accompanying drawing, wherein like reference characters refer to similar features throughout the various views.

THE PREFERRED EMBODIMENT

Figure 1:
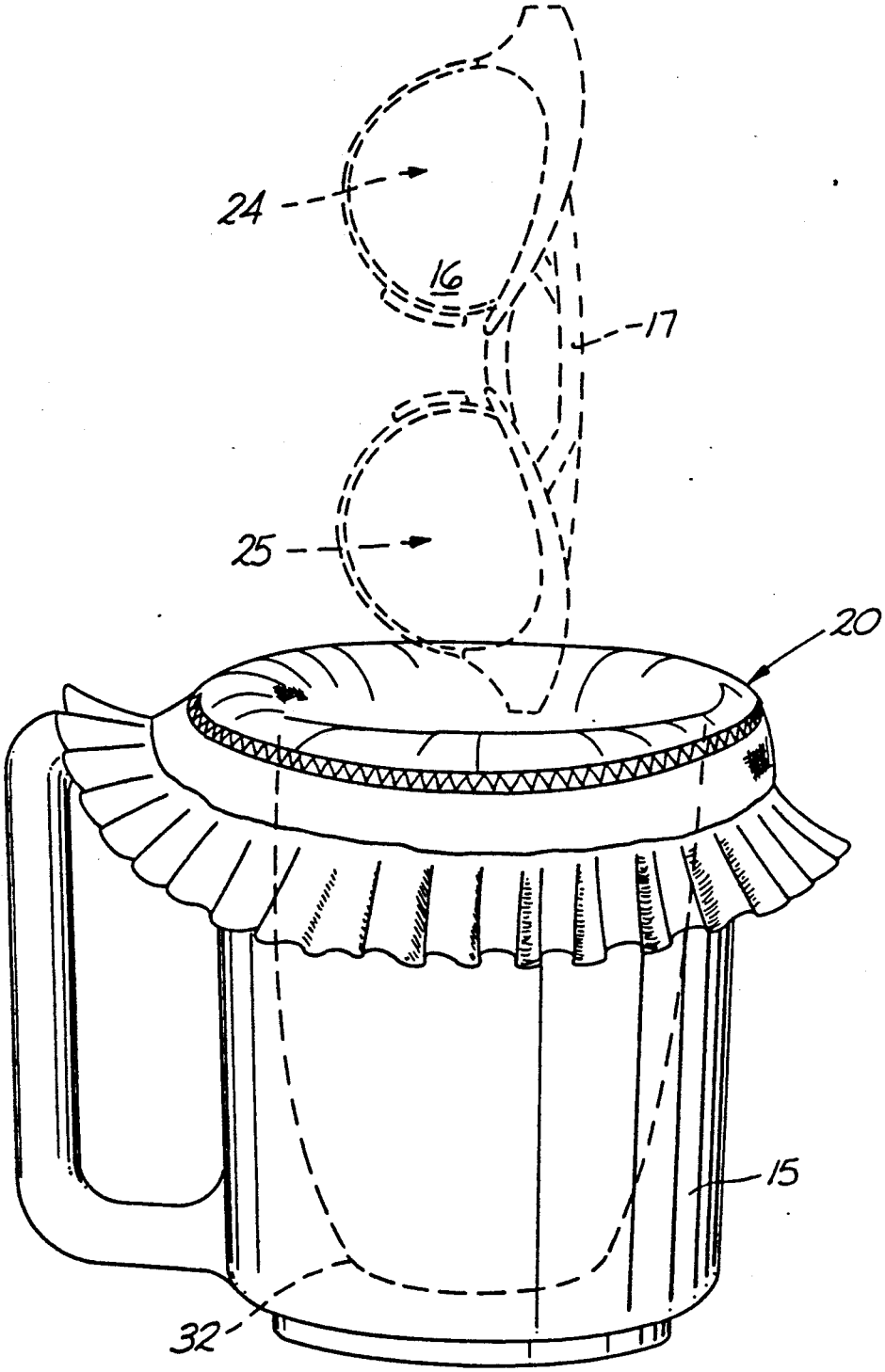
FIG. 1 is a perspective view of an eyeglass holder embodiment of the invention, namely a lined mug.
Figure 2:
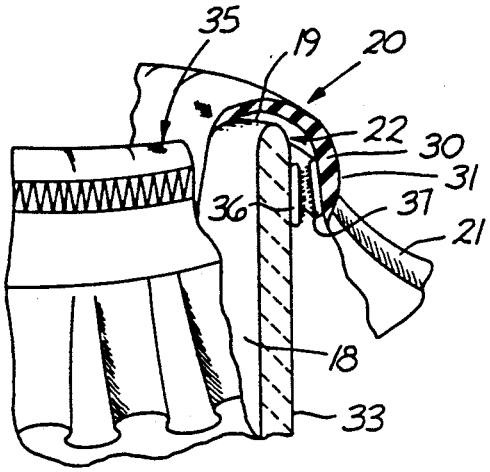
FIG. 2 is a fragmental view of the lined mug, partly in section.

As may be seen from FIG. 1, the coffee mug 15, or equivalent sized open mouth receptacle, is of ideal weight, circumference and depth to receive the (pair of) eyeglasses or spectacles 16 thereinto in an upright position with bows 17 closed. The decorative protective liner 20 fits inside the mug 15, hugging the inner wall 18 and extends over the mug rim 19 with the ruffled fringe 21 about the outside rim wall 22, as better seen in FIG. 2. Thus, the eyeglasses 16 may be conveniently inserted and stored in and retrieved from the mug 15 without special care or expertise, and the shock of any impact is taken up by the protective liner 20 so that the eyeglasses will not be damaged. Also the liner protects the lenses 24, 25 from being scratched or soiled.

Figure 3:
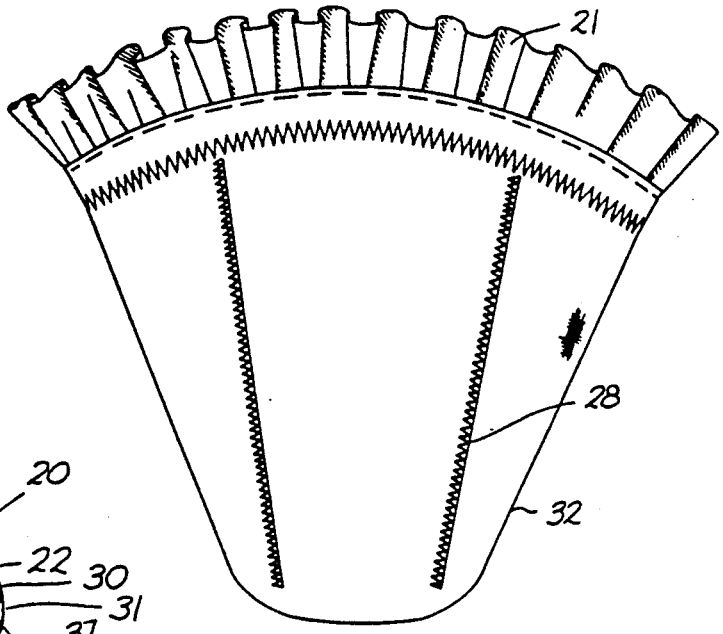
FIG. 3 is a side view of a mug liner embodiment of the invention ready for insert in a container mug.
Figure 4:
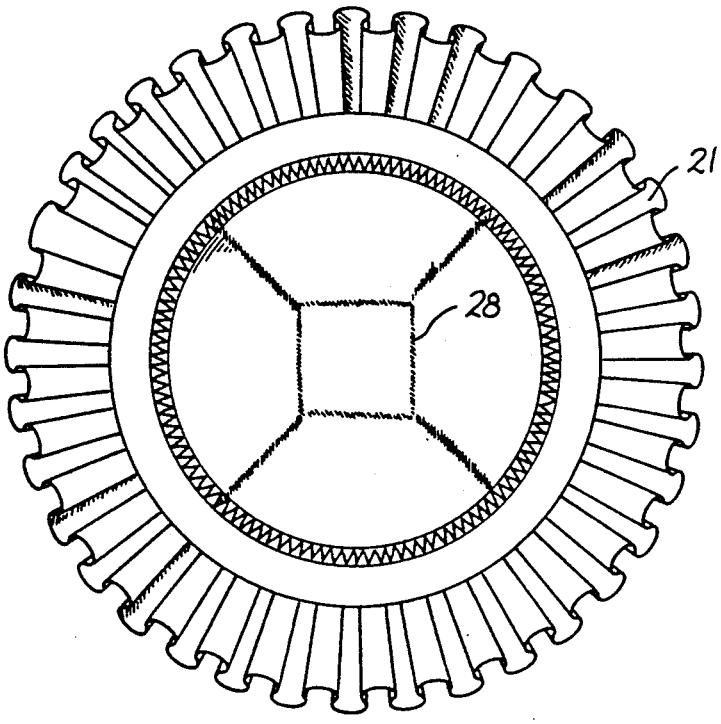
FIG. 4 is a plan view of a quilted fabric embodiment of the mug liner afforded by this invention.

The liner 20 in the preferred embodiment of FIGS. 3, 4 and 5 is of a quilted foam 30 backed fabric 31 cut and stitched at seams 28, etc. to fit into the coffee mug 15, with the ruffled edge 21 folded over the rim 19 of the mug. The tapered body 32 of the liner further keeps the eyeglasses 16 from impacting the hard ceramic sidewall 33 of the mug 15 and channels the eyeglasses 16 to rest in a position with part of the frames protruding for easy grasping and removal.

In order to more firmly hold the liner in place than simply by a fold or crease 35 in the liner, the fastener tabs 36, 37, respectively attached to the mug outer surface and the inner surface of the liner folded over rim at three or more mating positions about the mug, secure the liner in place to bear the weight and insertion impact of the eyeglasses 16 without displacement. Fastener tabs 36 may be glued to the surface of the rim of the mug 15, and tabs 37 sewed to the liner 22, for example, and may be appropriately adhesive tabs or artificial cockleburr type fabric pads sold as "Velcro" brand fasteners. Preferably the tabs are such that the liner may be removed and replaced, such as for washing.

It is clear therefore that a new and useful method of storing eyeglasses when not in use and novel product therefor is afforded by this invention which resolves prior art problems. Accordingly those novel features of the invention are set forth in particularity in the following claims.

I claim:

1. The method of converting a drinking receptacle into a container for storing and protecting eyeglasses when not is use comprising the steps of:

inserting into the drinking receptacle a tapered body protective liner fitting for preventing damage to the eyeglasses when entered or removed, said fitting being shaped for hugging interior wall portions at the cylindrical open mouth of the drinking receptacle and extending over the rim to soften impact on entering of the eyeglasses, said liner fitting having a diameter great enough for receiving loosely said eyeglasses to guide them into a resting position, and being of a depth for storing the eyeglasses with bows closed in an upright position in contact with the protective liner of said fitting about the rim when the eyeglasses are inserted in the receptacle with a portion of the bows extending from the mouth of the receptacle to permit grasping of the bows to remove the eyeglasses, so that the eyeglasses are stored to lean against the protective liner at rim.

2. Eyeglass holder apparatus for storing and protecting eyeglasses when not in use comprising in combination:

a protective removable insert, closed-bottom liner fitting, a cylindrical drinking receptacle of a shape, diameter and length for positioning eyeglasses to extend partly within the receptacle with the fitting held in place by extending over the receptacle outer rim thereby to receive, pad, and guide said eyeglasses loosely into the fitting in a position with bows closed to stand substantially upright therein and lean against the rim with part of the bows extending from the mouth of the receptacle for grasping while cushioning eyeglasses contact with the receptacle upon entering and leaving.

* * * * *